US007731198B2

(12) United States Patent
Cho

(10) Patent No.: US 7,731,198 B2
(45) Date of Patent: Jun. 8, 2010

(54) BALL RETURNING TENT NET

(76) Inventor: Kwang Han Cho, 10126 Reseda Blvd., #110, Northridge, CA (US) 91324

( * ) Notice: Subject to any disclaimer, the term of this patent is extended or adjusted under 35 U.S.C. 154(b) by 0 days.

(21) Appl. No.: 11/849,116

(22) Filed: Aug. 31, 2007

(65) Prior Publication Data

US 2009/0062026 A1 Mar. 5, 2009

(51) Int. Cl.
*A63B 63/00* (2006.01)
*A63B 69/36* (2006.01)

(52) U.S. Cl. ..... 273/396; 273/400; 473/197; 473/435

(58) Field of Classification Search ..... 273/398–402, 273/394–397; 473/476, 478, 434, 435, 454, 473/456, 198
See application file for complete search history.

(56) References Cited

U.S. PATENT DOCUMENTS 1,540,670 A * 6/1925 Vidmer ..... 473/190
4,883,272 A * 11/1989 Lay ..... 473/436
5,088,740 A * 2/1992 Peterson ..... 273/410
5,823,885 A * 10/1998 Stempfer ..... 473/197
6,165,085 A * 12/2000 Lubin ..... 473/478
6,319,145 B1 * 11/2001 Coughlan ..... 473/197
6,793,594 B1 * 9/2004 Grant ..... 473/476
6,881,154 B2 * 4/2005 Neskudla et al. ..... 473/197
7,021,630 B1 * 4/2006 Cho ..... 273/401
2003/0032493 A1 * 2/2003 Lin ..... 473/197
2003/0224866 A1 * 12/2003 Chen ..... 473/197

* cited by examiner

*Primary Examiner*—Mark S Graham
(74) *Attorney, Agent, or Firm*—John K. Park; Park Law Firm

(57) ABSTRACT

A ball returning tent net includes a frame that is supported on the ground on three or four contact points, and a ball-catch enclosure that is supported by the frame. The ball-catch enclosure includes an aperture that is adapted to pass a ball through, and a rear wall that is adapted to catch the ball and a bottom net. The frame includes a front frame member that supports the aperture and a rear frame member that supports the rear wall. The bottom net is inclined downward toward the front frame member. The ball-catch enclosure further includes an anti-sagging device that prevents sagging of the bottom net.

5 Claims, 6 Drawing Sheets

BALL RETURNING TENT NET

BACKGROUND OF THE INVENTION

The present invention relates to a practice net for use in various sports such as baseball, golf, etc. More specifically, one present invention relates to a tent-shaped net designed to capture balls within its enclosure for easy retrieval.

Practice nets are generally used to contain moving balls in order to eliminate the need to retrieve the balls.

SUMMARY OF THE INVENTION

The present invention aims to provide a portable, lightweight, and easy to use exercise platform by which users can practice various sports activities.

The present invention provides a ball returning tent-net that comprises a frame that is adapted to be supported on the ground at a predetermined number of contact points and a ball-catch enclosure that is supported by the frame. The preferred embodiment of this invention contains three or four contact points.

The ball-catch enclosure comprises an aperture that is adapted to pass a ball through, a rear wall that is adapted to catch the ball, and a bottom net. The bottom net is inclined downward toward the front frame member and the aperture so that the balls can be collected in a designated location for easy retrieval.

The ball-catch enclosure further comprises an anti-sagging device that prevents sagging of the bottom net. Without the anti-sagging device, the bottom net may sag, preventing the ball from rolling to the aperture. The anti-sagging device keeps the bottom net taut so that the balls do not sink into a sagging bottom net. A firmer bottom net facilitates the balls to roll down the bottom net to a ball stopping hand positioned near the bottom of the aperture.

In one embodiment of this invention where there are three contact points, the anti-sagging device comprises a support strip that is extended from the apex of the bottom net and is detachably attached to the rear frame member. In this configuration, the bottom net is triangular in shape.

In another embodiment of this invention where there are four contact points, the anti-sagging device comprises a support strip that is, at one end, detachably attached to the rear side of the bottom net, and, at the other end, attached to the ground. The anti-sagging device aims to pull the rear side of the bottom net away from the aperture so that the bottom net is taut, facilitating the ball to roll to the aperture.

The ball-catch enclosure is supported by a plurality of sleeves into which the front frame member and rear frame member are inserted. In a preferred embodiment of this invention, the front frame member and the rear frame member comprise two or more elastic pole segments that are attached end to end. Each elastic pole segment comprises a hollow rod.

In an embodiment of the invention where there are three contact points, a pole connector connects the front frame member and the rear frame member at the top of the ball returning tent-net. The pole connector comprises a T-shaped shaped member to which the pole segments of the front frame member and the rear frame member are detachably fixed.

In an embodiment of the invention where there are four contact points, the pole segments, which are inserted into the sleeves, intersect at the top of the ball returning tent-net.

The ball-catch enclosure comprises ground strips that are extended from the corners of the bottom net. Ground pins are attached to the ground strips. Each ground pin is inserted to the free end of the hollow rod. This ensures that the ball catch enclosure is securely attached to the front and rear frame members and prevents the ball catch enclosure from sagging.

A ball returning tent-net makes it convenient for practicing various sports activities because it is light, easy to assemble, and does not take a lot of space. The user can comfortably take advantage of the ball returning tent-net in the backyard, garage, etc. A golfer, for instance, can take a full swing and strike a golf ball without having to retrieve the golf ball or worry about where the ball will land.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

The applicant's U.S. Pat. Nos. 7,198,274, 7,021,630, and U.S. patent application Ser. Nos. 10/904,942, 11/393,975 are incorporated by reference as if they are fully set forth herein.

Figure 1:
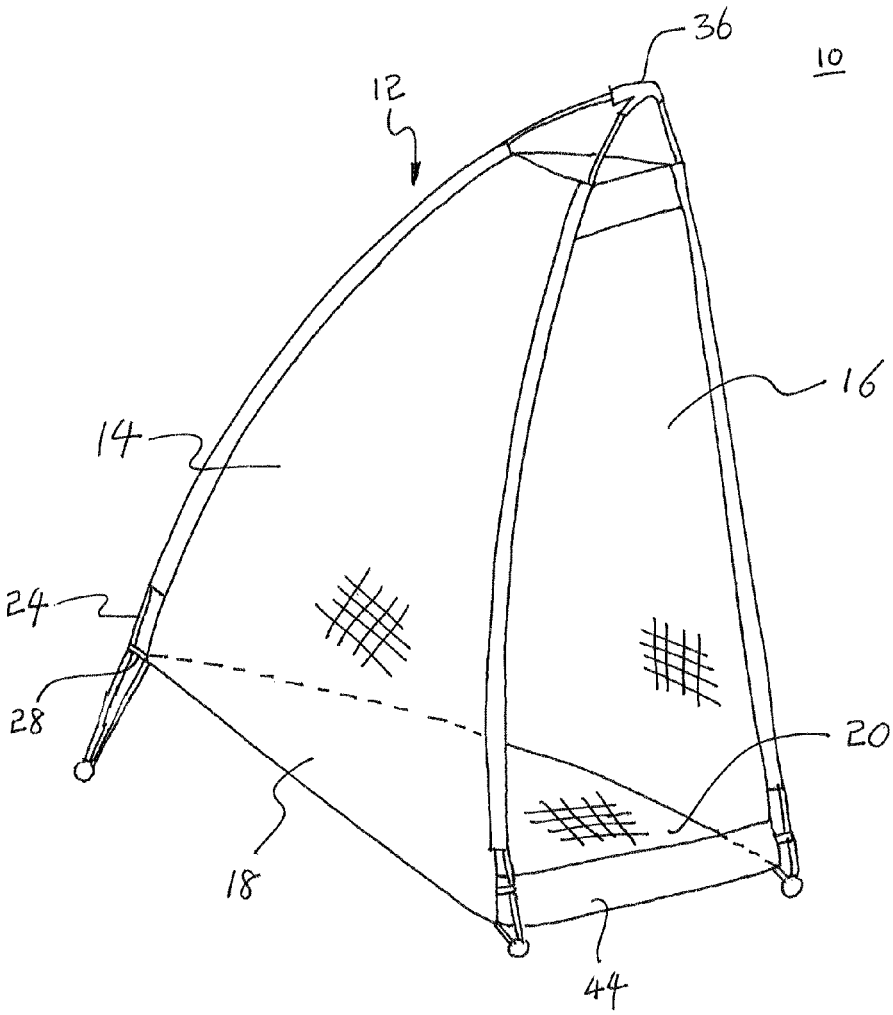
FIG. 1 is a perspective view of a ball returning tent net that has a triangular bottom net shape.

FIG. 1 shows a ball returning tent net 10 that includes a frame 12 that is adapted to he supported on the ground on a predetermined number of contact points and a ball-catch enclosure 14 that is supported by the frame 12.

The ball-catch enclosure 14 comprises an aperture 16 that is adapted to pass a ball through, a rear wall 18 that is adapted to catch the ball and a bottom net 20.

Figure 2:
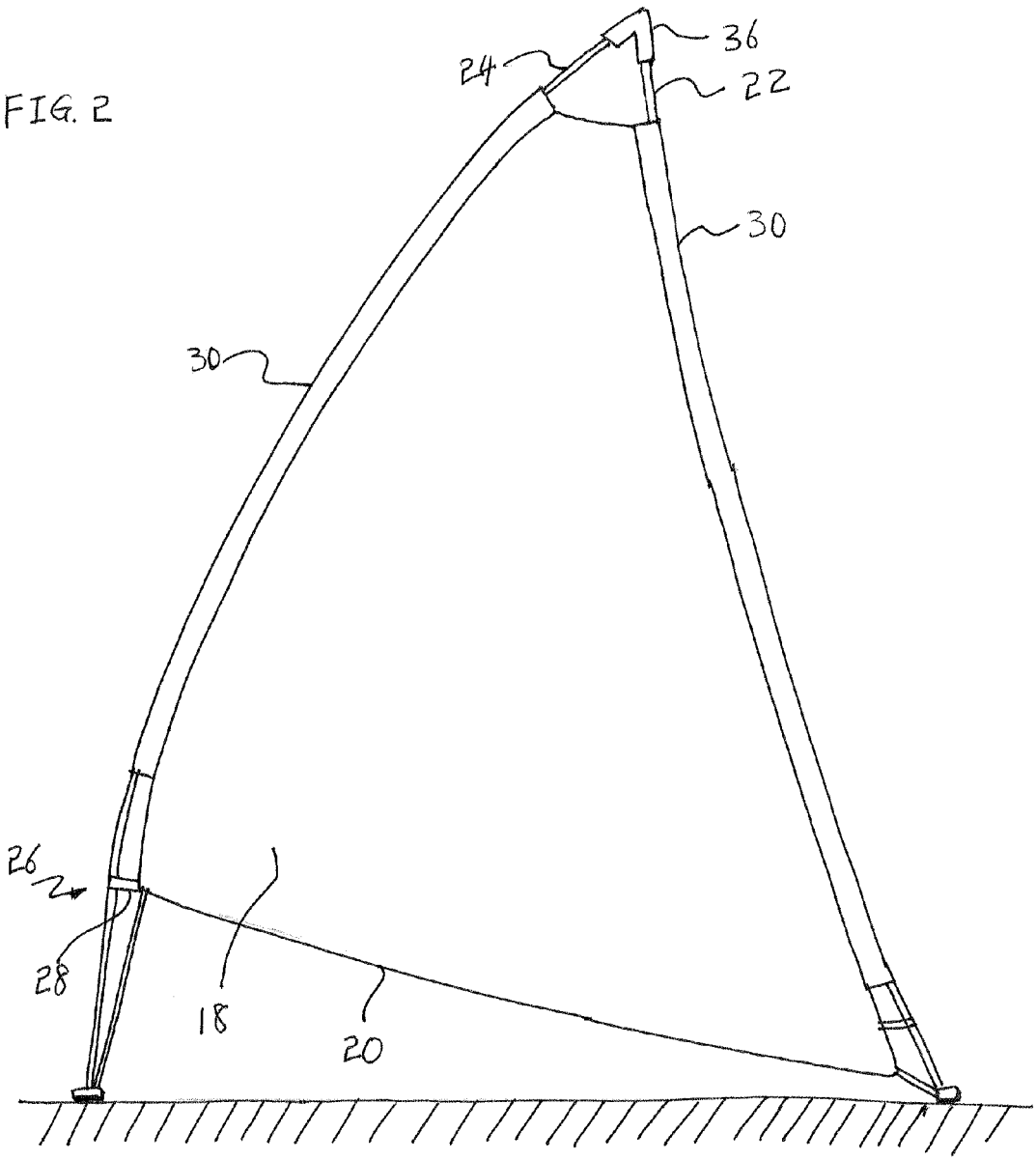
FIG. 2 is a side elevation view of the ball returning tent net.

FIG. 2 shows that the frame 12 comprises a front frame member 22 that supports the aperture 16 and a rear frame member 24 that supports the rear wall 18.

The bottom net 20 is inclined downward toward the front frame member 22.

The ball-catch enclosure 14 further comprises an anti-sagging device 26 that prevents sagging of the bottom net 20.

Figure 5:
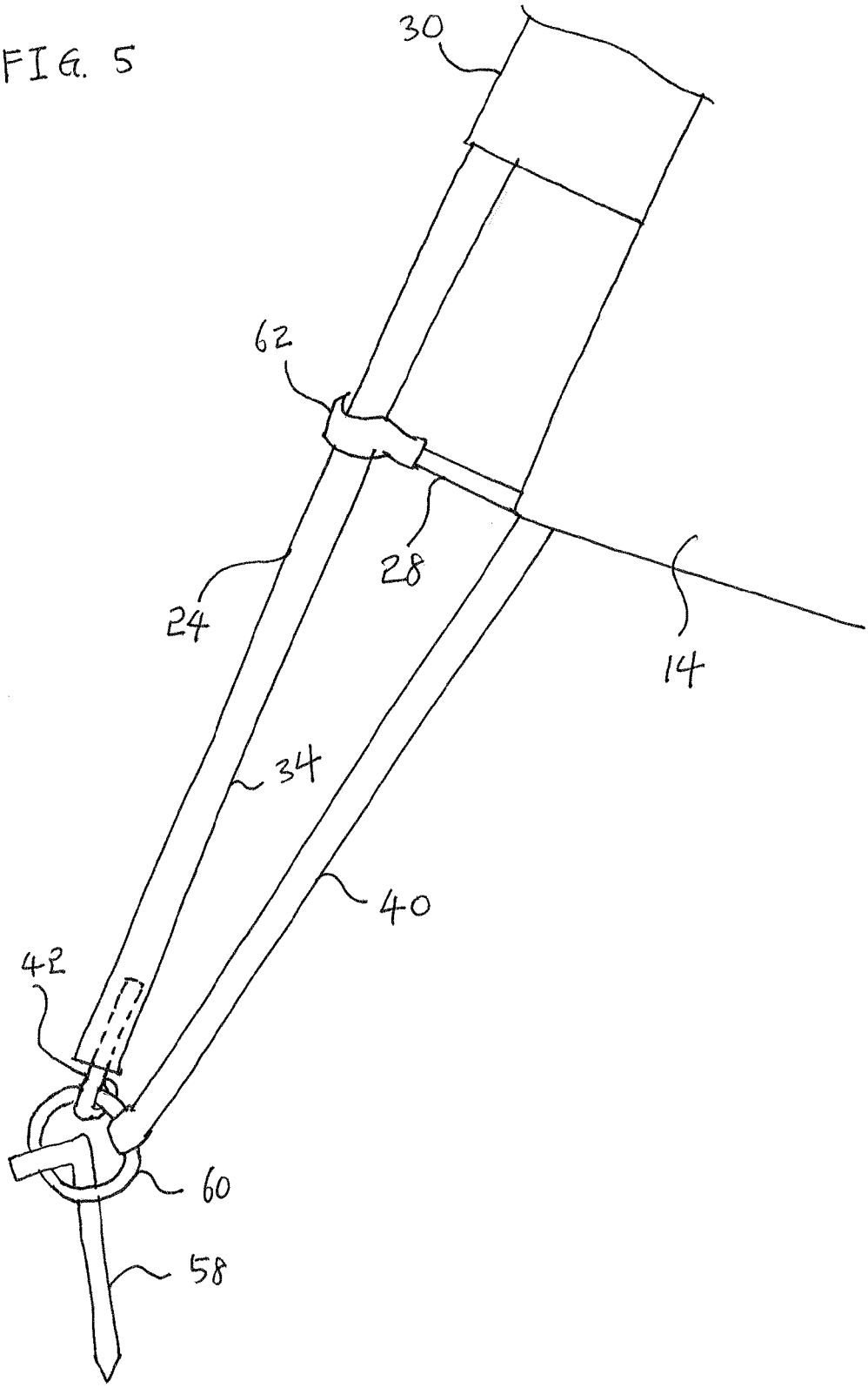
FIG. 5 is a perspective view showing a support strip, a ground strip and a ground pin.

In the embodiment shown in FIGS. 1 and 2, the predetermined number of contact points is three (3). The bottom net 20 has a triangular shape. The anti-sagging device 26 comprises a support strip 28 that is extended from the apex of the bottom net 20 and is detachably attached to the rear frame member 24. The support strip 28 is attached to the rear frame member 24 with a hook as shown in FIG. 5.

The ball-catch enclosure 14 further comprises a plurality of sleeves 30. The front frame member 22 and the rear frame member 24 are inserted into the sleeves 30, whereby the ball-catch enclosure 14 is supported by the front frame member 22 and the rear frame member 24.

Figure 3:
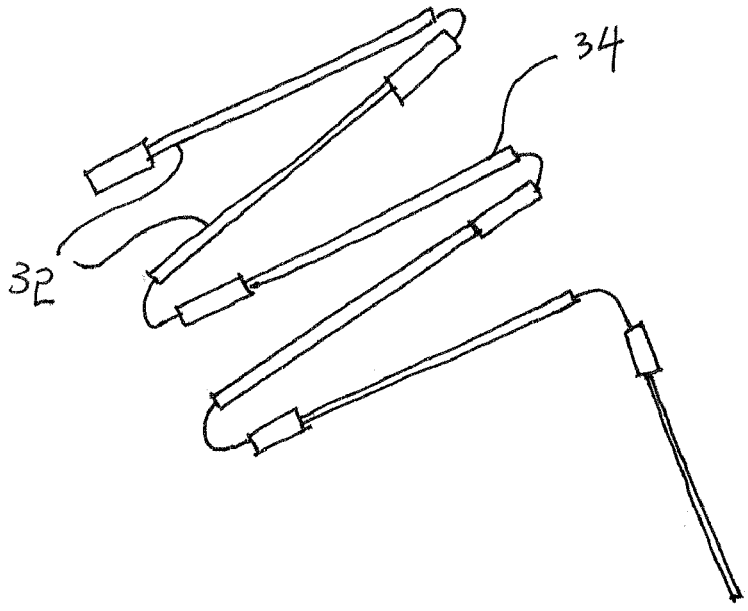
FIG. 3 is a plan view showing pole segments.

FIG. 3 shows that each of the front frame member 22 and the rear frame member 24 comprises two or more elastic pole segments 32 that are attached end to end. Each of the pole segments 32 comprises a hollow rod 34.

Figure 4:
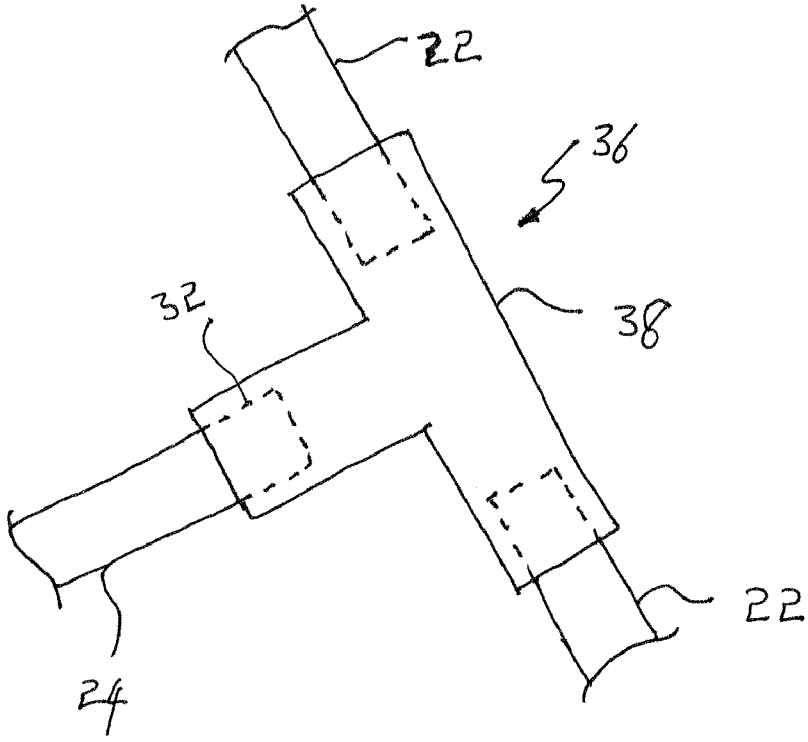
FIG. 4 is a perspective view showing a pole connector.

FIG. 4 shows that the frame 12 further comprises a pole connector 36 that connects the front frame member 22 and the rear frame member 24 at the top of the ball returning tent net 10.

The pole connector 36 comprises a T-shaped member 38 to which the pole segments 32 of the front frame member 22 and the rear frame member 24 are fixed.

Referring back to FIGS. 1 and 2, the ball catch enclosure 14 further comprises three ground strips 40 that are extended from the corners of the bottom net 20, and three ground pins 42 attached to the ground strips 40. FIG. 5 shows that each of the ground pins 42 is inserted to the free end of the hollow rod 34. A peg 58 is used to fix the ground strip 40 to the ground with a ring 60.

Referring back to FIG. 1, the aperture 16 comprises a ball stopping band 44 that are positioned at the bottom of the aperture 16, whereby balls rolled down the bottom net 20 are stopped near the aperture 16.

Figure 6:
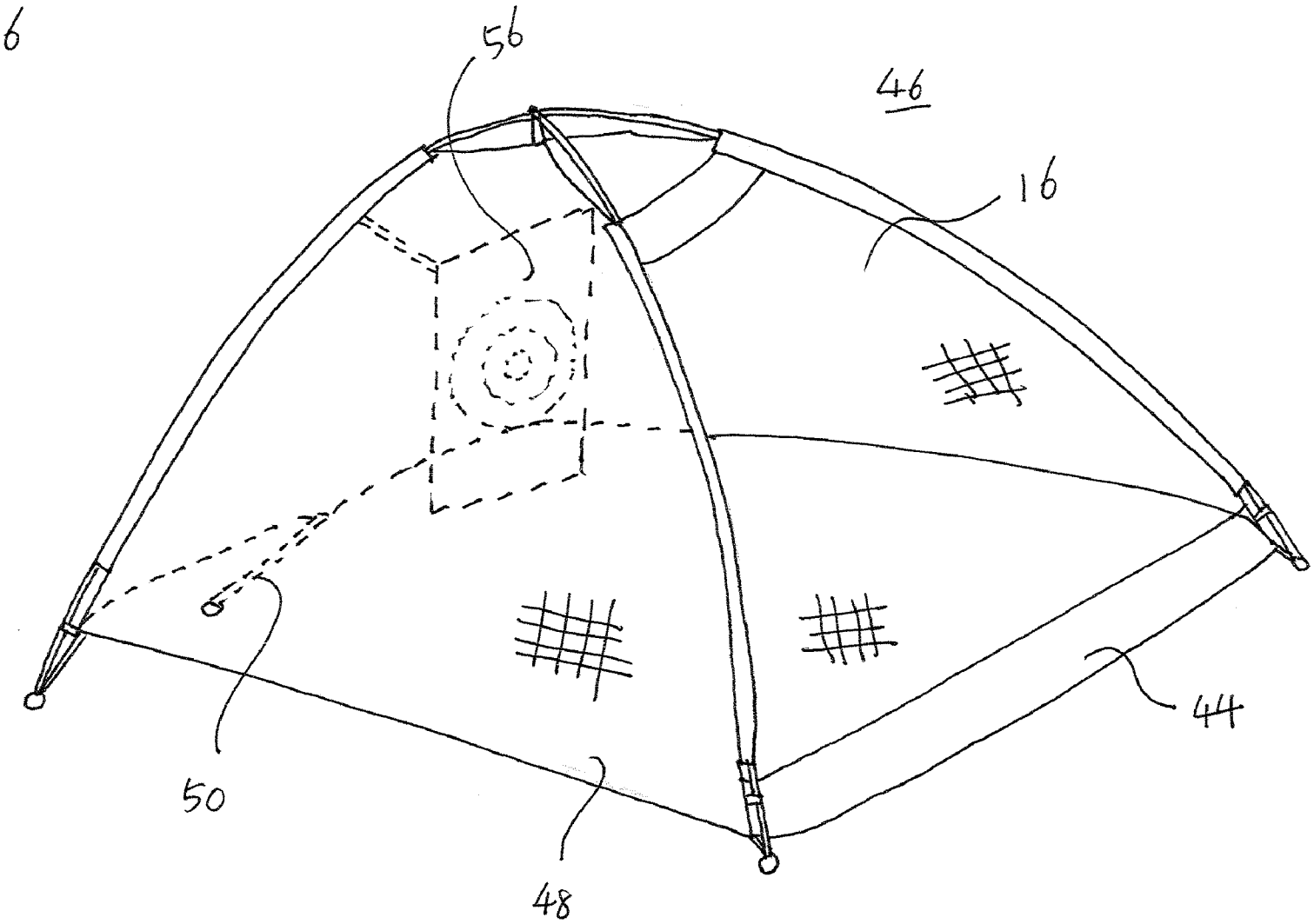
FIG. 6 is a perspective view of a ball returning tent net that has a rectangular bottom net shape.
Figure 7:
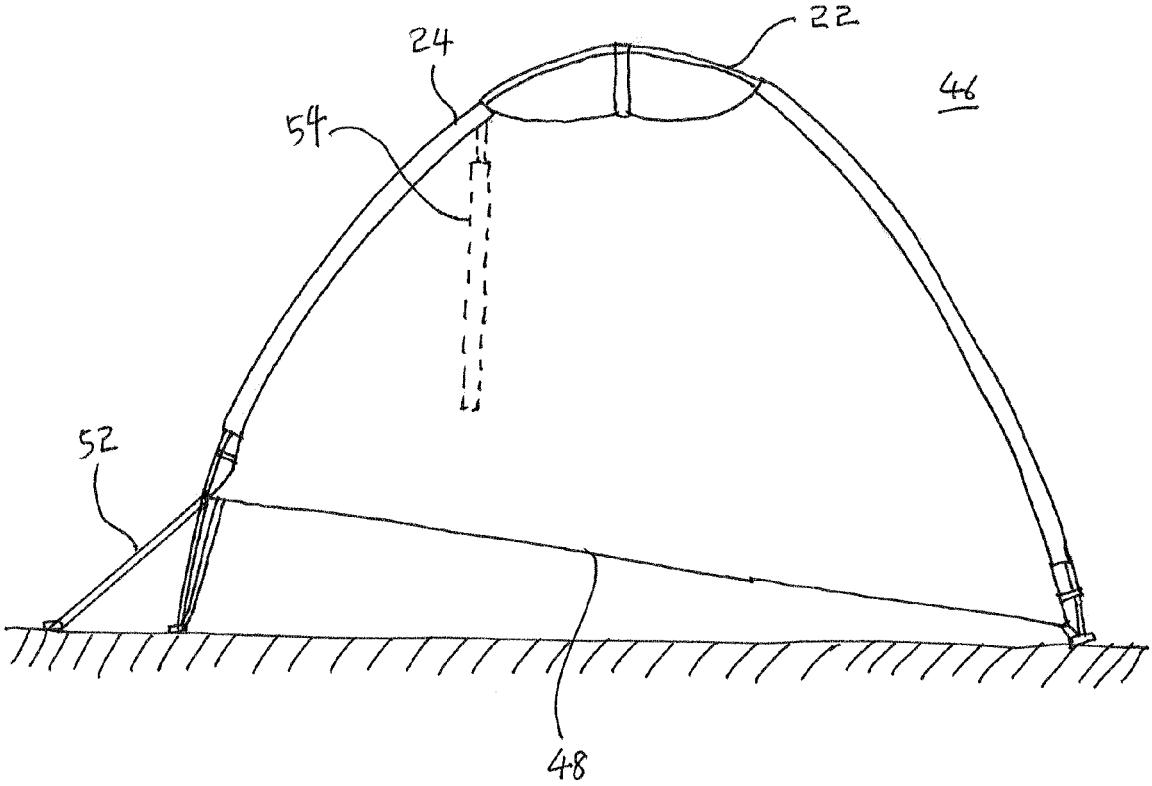
FIG. 7 is a side elevation view of the ball returning tent net.
Figure 8:
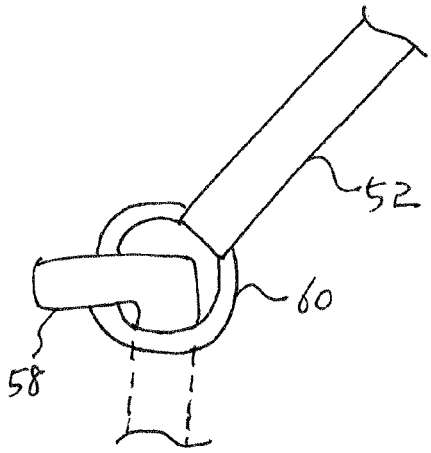
FIG. 8 is a schematic view showing a support strip.

FIGS. 6 and 7 show another embodiment of a ball returning tent net 46. In this embodiment, the predetermined number of contact points is four (4). A bottom net 48 has four sides. An anti-sagging device 50 comprises a support strip 52 that is extended from the rear side of the bottom net 48 and is adapted to be fixed on the ground on which the frame 12 is placed. FIG. 8 shows how the support strip 52 is fixed on the ground.

The ball returning tent net further comprises a target 54 that is positioned inside the ball-catch enclosure 14. The target 54 comprises a hitting surface 56 towards which balls are directed.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A ball returning tent net comprising:

a) a frame that is adapted to be supported on the ground on three contact points; and b) a ball-catch enclosure that is supported by the frame;

wherein the ball-catch enclosure comprises an aperture that is adapted to pass a ball through, a rear wall that is adapted to catch the ball and a bottom net;

wherein the frame comprises two front frame members that support the aperture and a rear frame member that supports the rear wall;

wherein the bottom net is inclined downward toward the two front frame members;

wherein the ball-catch enclosure further comprises an anti-sagging device comprising a support strip that prevents sagging of the bottom net, wherein the bottom net has a triangular shape, wherein the support strip is extended from an apex of the bottom net and is detachably attached to the rear frame member, wherein the bottom net is extended from the ball catch enclosure, and wherein the triangular shape of the bottom net is defined and supported by three points consisting of two of the three contact points of the two front frame members and the support strip on the rear frame member;

wherein the ball-catch enclosure further comprises a plurality of sleeves, wherein the front frame members and the rear frame member are inserted into the sleeves, whereby the ball-catch enclosure is supported by the front frame members and the rear frame member;

wherein each of the front frame members and the rear frame member comprises two or more elastic pole segments that are attached end to end, wherein each of the pole segments comprises a hollow rod;

wherein the frame further comprises a pole connector that connects the front frame members and the rear frame member at the top of the ball returning tent net.

2. The ball returning tent net of claim 1, wherein the pole connector comprises a T-shaped member to which the pole segments of the front frame members and the rear frame member are fixed.

3. The ball returning tent net of claim 1, wherein the ball catch enclosure further comprises three ground strips that are extended from the corners of the bottom net, and three ground pins attached to the ground strips, wherein each of the ground pins is inserted to the free end of the hollow rod.

4. The ball returning tent net of claim 1, wherein the aperture comprises a ball stopping band that is positioned at the bottom of the aperture, whereby balls rolled down the bottom net are stopped near the aperture.

5. The ball returning tent net of claim 1, further comprising a target that is positioned inside the ball-catch enclosure, wherein the target comprises a hitting surface towards which balls are directed.

* * * * *